United States Patent [19]

Preda

[11] Patent Number: 4,480,924

[45] Date of Patent: Nov. 6, 1984

[54] STIRRER-MIXER FOR RETORTS IN PARTICULAR, WHEREIN THE INSUFFATION IS CARRIED OUT THROUGH THE STIRRER ITSELF

[76] Inventor: Stefano Preda, via Palermo 17, Trento, Italy

[21] Appl. No.: 494,347

[22] Filed: May 13, 1983

[30] Foreign Application Priority Data

May 13, 1982 [IT] Italy ..... 21845/82[U]

[51] Int. Cl.[3] ..... B01F 7/16; B01F 13/02; B01F 15/06

[52] U.S. Cl. ..... 366/102; 366/144; 261/87; 432/151

[58] Field of Search ..... 366/102, 105, 104, 144, 366/147; 261/87; 48/62, 76, 77, 85.2, 99, 101, 123; 432/135, 139, 151; 202/120, 121, 124, 265; 68/15, 183

[56] References Cited

U.S. PATENT DOCUMENTS

| | | | |
|---|---|---|---|
| 104,716 | 6/1870 | Pupas et al. | 261/87 |
| 658,948 | 10/1900 | Gregg | 366/102 |
| 1,659,310 | 2/1928 | Beaumont | 366/144 |

FOREIGN PATENT DOCUMENTS

| | | | |
|---|---|---|---|
| 1230399 | 12/1966 | Fed. Rep. of Germany | 261/87 |
| 395105 | 8/1973 | U.S.S.R. . | |

*Primary Examiner*—Philip R. Coe
*Assistant Examiner*—Michael Knick
*Attorney, Agent, or Firm*—McGlew and Tuttle

[57] ABSTRACT

To stir up and mix the substances held inside a retort, a blade is used, of a shape corresponding to that of the retort itself. Inside the blade there is a conduit, connected to outer devices for the admission of gas, and provided with a series of apertures, directed towards the inner part of the retort, for the discharge of the gas.

7 Claims, 1 Drawing Figure

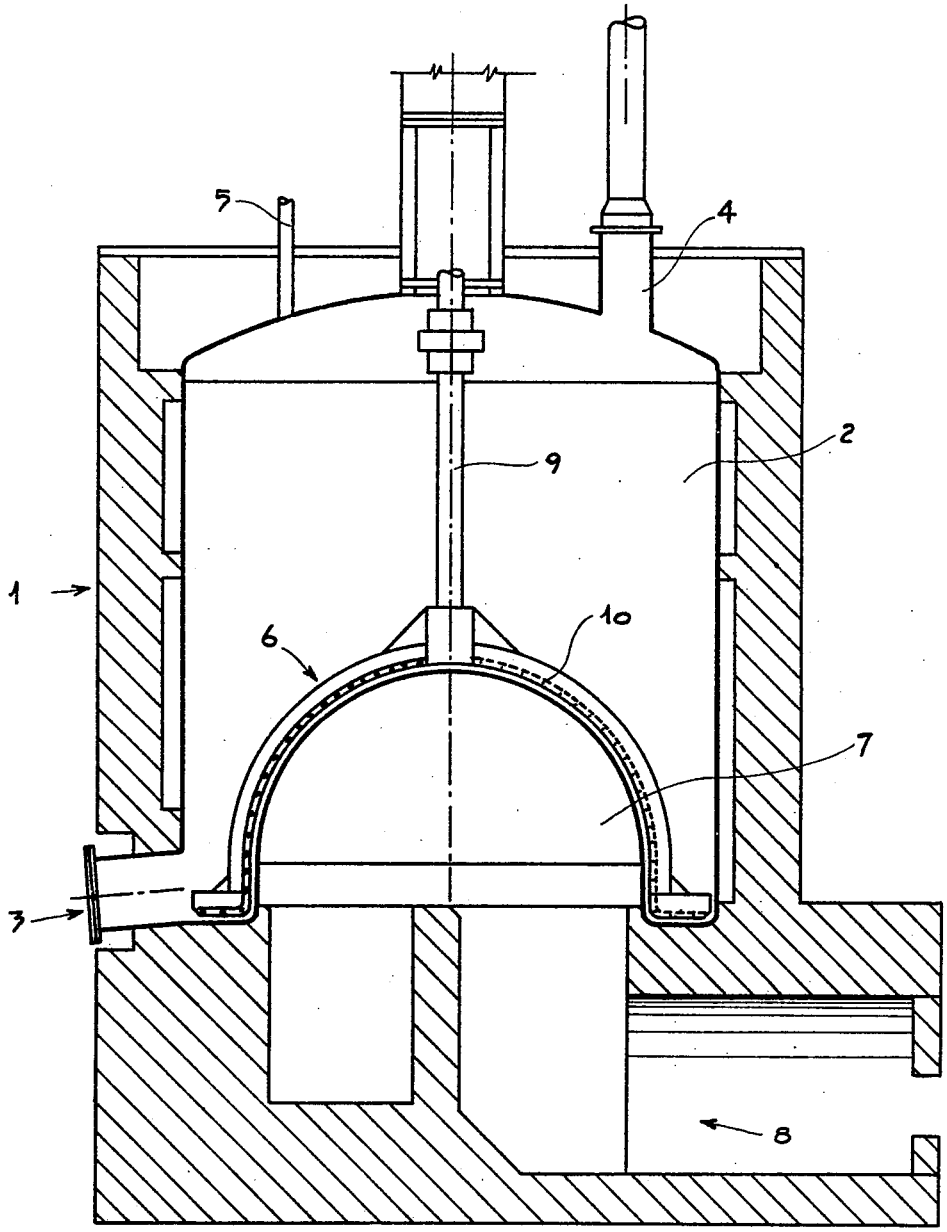
5
4
2
9
1
10
6
7
3
8

STIRRER-MIXER FOR RETORTS IN PARTICULAR, WHEREIN THE INSUFFATION IS CARRIED OUT THROUGH THE STIRRER ITSELF

The present invention provides for a stirrer-mixer for retorts in particular, allowing the injection of insufflation of air inside the retort during stirring. The stirrer according to the invention is provided with systems suitable for circulating gas on the inside thereof during the mixing movement; said gas is then discharged through suitable apertures present on the stirrer itself.

It is known that, for the making of several substances, processes are used during whose cycles said substances are uninterruptedly stirred and mixed up inside proper containers—called retorts—which are meant to keep these substances at the required physical conditions during stirring. More specifically, many products or compounds need, during stirring, a certain amount of gas (often air) whose action regularizes the working cycle. To this end, tubular elements are often used, as coils or the like, located at the bottom of the retort, through which the necessary gas is blown. In other cases, this coil is housed in a seat made in a wall of the retort, preferably on the bottom thereof.

Both the above solutions, however, are likely to cause many inconveniences, because they do not allow completely and practically the exploitation or utilization of the available room inside the container and, more particularly, because there are concomitantly formed scarcely accessible spaces which get filled with the treated material. As a consequence, it is necessary to take apart the apparatus or to disassemble it into its pieces each time a thorough cleaning is required. To obviate these inconveniences, the present invention provides for a stirrer-mixer so shaped as to be linkable to external apparatus for blowing air or gas inside the retort, during mixing, through the stirrer itself.

This permits a more effective cleaning of the components, as well as a wider diffusion of gases in the substances, during stirring.

The present invention will be now described in detail, with special reference to a retort for the distillation of coal tar, it being understood that the stirrer-mixer according to the invention may be as well advantageously used in the treatment of other substances.

The description refers to the sole FIGURE of the accompanying drawing, representing, in schematic section, a retort with a stirrer according to the invention.

A retort indicated in its entirety by 1, of the type comprising a chamber 2 to which there are connected a discharge pipe 3 and a conduit 4 from which the distilled product flows out, is provided with a stirrer 6 of a shape complementary to that of the bottom wall 7 of the retort. The stirrer 6 is driven by a shaft 9 which is rotated around its own axis by apparatus not shown in the drawing. Both shaft 9 and stirrer 6 are hollow and the stirrer is provided, on the lower surface thereof, with a series of properly orientated holes 10. Shaft 9 is linked, at its outer end, to an apparatus not shown in the drawing for the admission under pressure of air or other gases. Due to this particular shape, the stirrer itself, while effecting the mixing up, can let the desired amount of gas inside the retort, so as to remove deposits—if any—or to prevent the formation thereof.

As no other devices are present inside the retort, it is possible to shape both the retort and the stirrer 6 in the most suitable way, which brings about further advantages. In the present case, for instance, the bottom wall of the retort has an upwardly and inwardly directed or concave hemispheric shape, which makes its surface broader, and allows a greater quantity of heat to be conveyed from a burner 8, located lower down in the retort and below the chamber 2 and adjacent the bottom wall 7, to the products to be mixed up.

Due just to the fact that no other devices are present inside the retort, it is possible to make the stirrer 6 of a shape exactly complementary to that of wall 7, thus allowing the stirrer to reach any zone on the inside of chamber 2, and thus avoiding the formation of recesses in which part of the material may stagnate. The discharge pipe or outlet means 3 for the inherently non-gaseous material, e.g. distillation residue, is arranged adjacent the lowermost point of the blade of the stirrer 6 or more specifically of its path, e.g. at the periphery of the stirrer blade or of its path, whereas the outlet conduit or outlet means 4 for the inherently gaseous material, e.g. distillation vapor, is arranged adjacent the top or upper end of the retort 1 or more specifically of the chamber 2 and thus remote from the stirrer blade.

Of course the sizes, as well as the employed materials, may vary according to the different requirements of use.

I claim:

1. Retort which comprises a pressure chamber having a bottom wall of upwardly and inwardly directed rounded shape and a burner arranged below the chamber and adjacent the bottom wall for conveying heat to the chamber at the bottom wall for pressure heat treatment of a material in the chamber, and a stirrer-mixer arrangement including a stirrer operatively disposed in the chamber for stirring such material and having admission means for providing insufflation through the stirrer itself, said admission means comprising at least one pipe portion for supplying a gas under pressure to the interior of the chamber during stirring, said stirrer containing a stirring portion of conforming complementary shape to that of the bottom wall and arranged in overlying relation to the bottom wall for stirring such material.

2. Retort of claim 1 wherein the stirring portion includes a blade for mixing the material in the chamber, the blade having a plurality of apertures arranged in flow connection with said pipe portion for blowing the gas supplied from said pipe portion into the chamber.

3. Retort of claim 2, wherein the stirrer includes a hollow upright shaft carrying the blade at the corresponding lower end portion of said shaft, and the blade comprises a hollow blade containing said apertures, and the shaft and blade together define said pipe portion for supplying the gas to the interior of the chamber.

4. Retort of claim 1, wherein said bottom wall has a concave hemispheric shape.

5. Retort which comprises a pressure chamber for pressure heat-treatment of a material therein and having a bottom wall of upwardly and inwardly directed rounded shape, and a stirrer-mixer arrangement including a stirrer operatively disposed in the chamber and provided with a blade of conforming complementary shape to that of the bottom wall and arranged in overlying relation to the bottom wall for movement along a stirring path for stirring such material, and admission means for providing insufflation through the stirrer itself and comprising at least one pipe portion for supplying a gas under pressure to the interior of the chamber during stirring, said blade having a plurality of apertures arranged in flow connection with said pipe portion for blowing the gas supplied from said pipe portion into the chamber at the bottom wall, and a discharge outlet arranged adjacent the corresponding lowermost point of the blade at the periphery of its stirring path for discharge of the non-gaseous portion of such treated material and an outflow conduit arranged adjacent the top of the chamber and remote from the blade for discharge of any corresponding gaseous portion of such treated material.

6. Retort of claim 5, wherein a burner is arranged below the chamber and adjacent the bottom wall for conveying heat to the chamber at the bottom wall for pressure heat treatment of the material in the chamber.

7. Retort of claim 4, wherein said bottom wall has a concave hemispheric shape.

* * * * *